US010814471B2

(12) United States Patent
Liu

(10) Patent No.: US 10,814,471 B2
(45) Date of Patent: Oct. 27, 2020

(54) TOOLBOX

(71) Applicant: ERSSON CO., LTD., Taichung (TW)

(72) Inventor: Ming-Hsien Liu, Taichung (TW)

(73) Assignee: Shun-Tsung Lu, Taichung (TW)

( * ) Notice: Subject to any disclaimer, the term of this patent is extended or adjusted under 35 U.S.C. 154(b) by 156 days.

(21) Appl. No.: 16/115,450

(22) Filed: Aug. 28, 2018

(65) Prior Publication Data

US 2020/0070333 A1 Mar. 5, 2020

(51) Int. Cl.

| | |
|---|---|
| ***B25H 3/02*** | (2006.01) |
| ***B65D 25/28*** | (2006.01) |
| *A45F 5/10* | (2006.01) |
| *G09F 23/00* | (2006.01) |

(52) U.S. Cl.

CPC ..... *B25H 3/02* (2013.01); *B65D 25/28* (2013.01); *B65D 25/2802* (2013.01); *A45F 2005/1093* (2013.01); *B65D 2525/285* (2013.01); *B65D 2525/289* (2013.01); *G09F 2023/0025* (2013.01)

(58) Field of Classification Search

CPC ..... B65D 2525/258; B65D 2525/289; B65D 2501/24885; B65D 2563/108; B65D 25/205; B65D 25/2814; B65D 25/2847; B25H 3/02; G09F 3/20; A45F 2005/1073; A45F 2005/1093; A45C 13/26

USPC ..... 16/422, 411

See application file for complete search history.

(56) References Cited

U.S. PATENT DOCUMENTS

| | | | | | |
|---|---|---|---|---|---|
| 5,475,896 | A * | 12/1995 | Wang | A47B 95/02 | 16/421 |
| 5,738,401 | A * | 4/1998 | Fan | A45F 5/1046 | 294/137 |
| 6,513,198 | B2 * | 2/2003 | Lu | B25G 1/12 | 16/421 |
| 2003/0140458 | A1 * | 7/2003 | Lin | B25H 3/02 | 16/431 |
| 2010/0052349 | A1 * | 3/2010 | Naeve | A45C 5/03 | 294/140 |

* cited by examiner

*Primary Examiner* — Mollie Impink

(74) *Attorney, Agent, or Firm* — Marshall A. Lemer; Bradford E. Mattes; Kleinberg & Lerner, LLP.

(57) ABSTRACT

A tool box has a box body and a handle. The box body has a mounting portion mounted at the box body. The mounting portion has an upper positioning recess and a lower positioning recess. The handle has a holding portion, a connecting portion, and a marking portion. The holding portion is an elongated board and is engaged with the lower positioning recess, a cross section of the holding portion being U-shaped with an opening facing upward. The connecting portion is formed at an inner end of the holding portion and is an upright board. The marking portion is formed at a top portion of the connecting portion and is an elongated board and is engaged with the upper positioning recess, a cross section of the marking portion being U-shaped with an opening facing downward.

6 Claims, 4 Drawing Sheets

TOOLBOX

BACKGROUND OF THE INVENTION

1. Field of the Invention

The present invention relates to a toolbox, and more particularly to a toolbox that has a detachable handle.

2. Description of Related Art

A conventional toolbox has a box body and a handle. The handle is mounted at a side surface of the box body. However, as multiple metal hand tools are placed in the box body, the box body has to sustain heavy weight. Therefore, the holding feel is not good for a user over a long time.

Another conventional toolbox further has a holding body. The holding body is mounted around the handle directly and is made of rubber. A trademark pattern is formed on a surface of the holding body. However, the holding body may be cracked or broken after a long time of use. The trademark pattern would fall off due to friction. Therefore, a user cannot recognize the toolbox. Also, the holding body is irreplaceable, so the whole toolbox needs to be changed once the holding body is broken.

SUMMARY OF THE INVENTION

The main objective of the present invention is to provide a toolbox that has a detachable handle.

The toolbox has a box body and a handle. The box body has a mounting portion mounted at the box body. The mounting portion has an upper positioning recess and a lower positioning recess. The handle has a holding portion, a connecting portion, and a marking portion. The holding portion is an elongated board and engaged with the lower positioning recess, a cross section of the holding portion being U-shaped with an opening facing upward. The connecting portion is formed at an inner end of the holding portion and is an upright board. The marking portion is formed at a top portion of the connecting portion and is an elongated board and engaged with the upper positioning recess, a cross section of the marking portion being U-shaped with an opening facing downward.

Other objects, advantages, and novel features of the invention will become more apparent from the following detailed description when taken in conjunction with the accompanying drawings.

DETAILED DESCRIPTION OF PREFERRED EMBODIMENT

Figure 1:
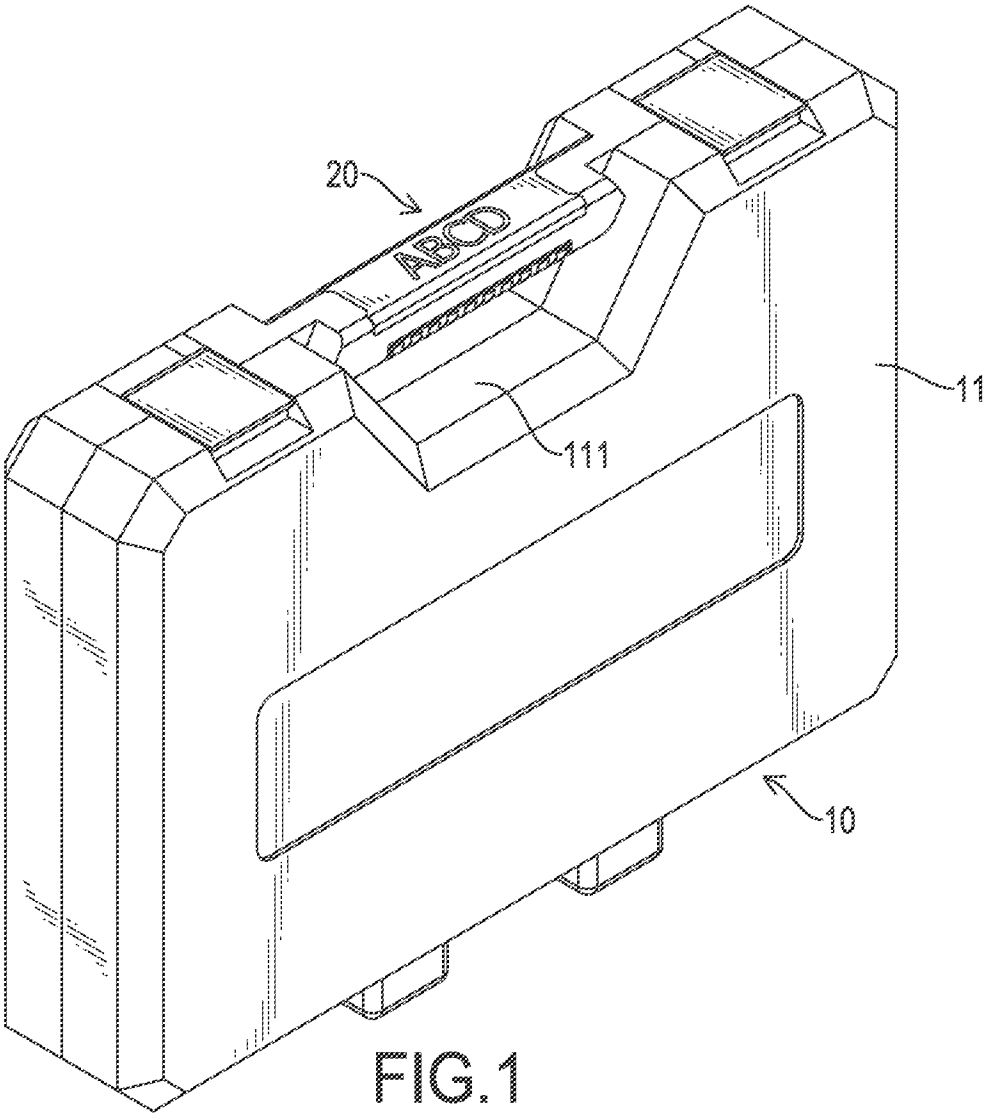
FIG. 1 is a perspective view of a toolbox in accordance with the present invention.

With reference to FIGS. 1 to 4, a toolbox 10 in accordance with the present invention comprises a box body 11 and a handle 20.

The box body 11 is hollow and rectangular in shape and has an accommodating recess 111 and a mounting portion 12. The accommodating recess 111 is formed in a top surface of the box body 11. The mounting portion 12 is mounted at the box body 11 above the accommodating recess 111. The mounting portion 12 is a rod and has a top surface, a bottom surface, an outer surface, an upper positioning recess 121, two upper limiting protruding portions 122, an upper engaging recess 123, a lower positioning recess 124, a lower engaging recess 125, and a connecting recess 126. The upper positioning recess 121 is formed in the top surface of the mounting portion 12 and has two side edges and an outer edge. The two upper limiting protruding portions 122 respectively protrude from the two side edges of the upper positioning recess 121, and each upper limiting protruding portion 122 is a trapezoidal block. Furthermore, the upper engaging recess 123 is formed in the outer edge of the upper positioning recess 121. The cross section of the upper engaging recess 123 is a trapezoid in shape. The lower positioning recess 124 is formed in the bottom surface of the mounting portion 12 and has an outer edge. The lower engaging recess 125 is formed in the outer edge of the lower positioning recess 124. The cross section of the lower engaging recess 125 is a trapezoid in shape. The connecting recess 126 is formed in the outer surface of the mounting portion 12. The connecting recess 126 communicates with the upper positioning recess 121 and the lower positioning recess 124, and this makes the connecting recess 126, the upper positioning recess 121 and the lower positioning recess 124 form a U-shaped space with an opening facing outward.

The handle 20 is detachably mounted around and engaged with the mounting portion 12 of the box body 11 and has a holding portion 21, a connecting portion 22, and a marking portion 23. The cross section of the handle 20 is U-shaped with an opening facing outward. The holding portion 21 is an elongated board and is engaged with the lower positioning recess 124. The cross section of the holding portion 21 is U-shaped with an opening facing upward. The holding portion 21 has an inner end, an outer end, and a tower engaging protruding portion 211. The lower engaging protruding portion 211 protrudes from the outer end of the holding portion 21. The shape of the lower engaging protruding portion 211 corresponds to the shape of the lower engaging recess 125, and the lower engaging protruding portion 211 may be engaged with the lower engaging recess 125.

The connecting portion 22 is formed at the inner end of the holding portion 21. The connecting portion 22 is a board and is engaged with the connecting recess 126. Preferably, an injection recess 221 is formed in an outer surface of the connecting portion 22 and the holding portion 21. A holding block 30 may be attached to the injection recess 221 of the handle 20 by plastic injection, and this may improve the holding feel for a user.

The marking portion 23 is formed at a top portion of the connecting portion 22. The marking portion 23 is an elongated board and is engaged with the upper positioning recess 121. The cross section of the marking portion 23 is U-shaped with an opening facing downward. The marking portion 23 has two ends, an outer side, and an upper engaging protruding portion 231. The upper engaging protruding portion 231 protrudes from the outer side of the marking portion 23. The shape of the upper engaging protruding portion 231 corresponds to the shape of the upper engaging recess 123, and the upper engaging protruding portion 231 may be engaged with the upper engaging recess 123. Preferably, the marking portion 23 has two alignment recesses 232. The two alignment recesses 232 are respectively formed in the two ends of the marking portion 23. Each alignment recess 232 is trapezoidal in shape, and the shape of each alignment recess 232 corresponds to the shape of each upper limiting protruding portion 22. Furthermore, a marking structure 233 is formed on a top surface of the marking portion 23. The marking structure 233 can be grooves. A trademark pattern 40 is formed on the marking structure 223 by plastic injection or by printing.

Figure 2:
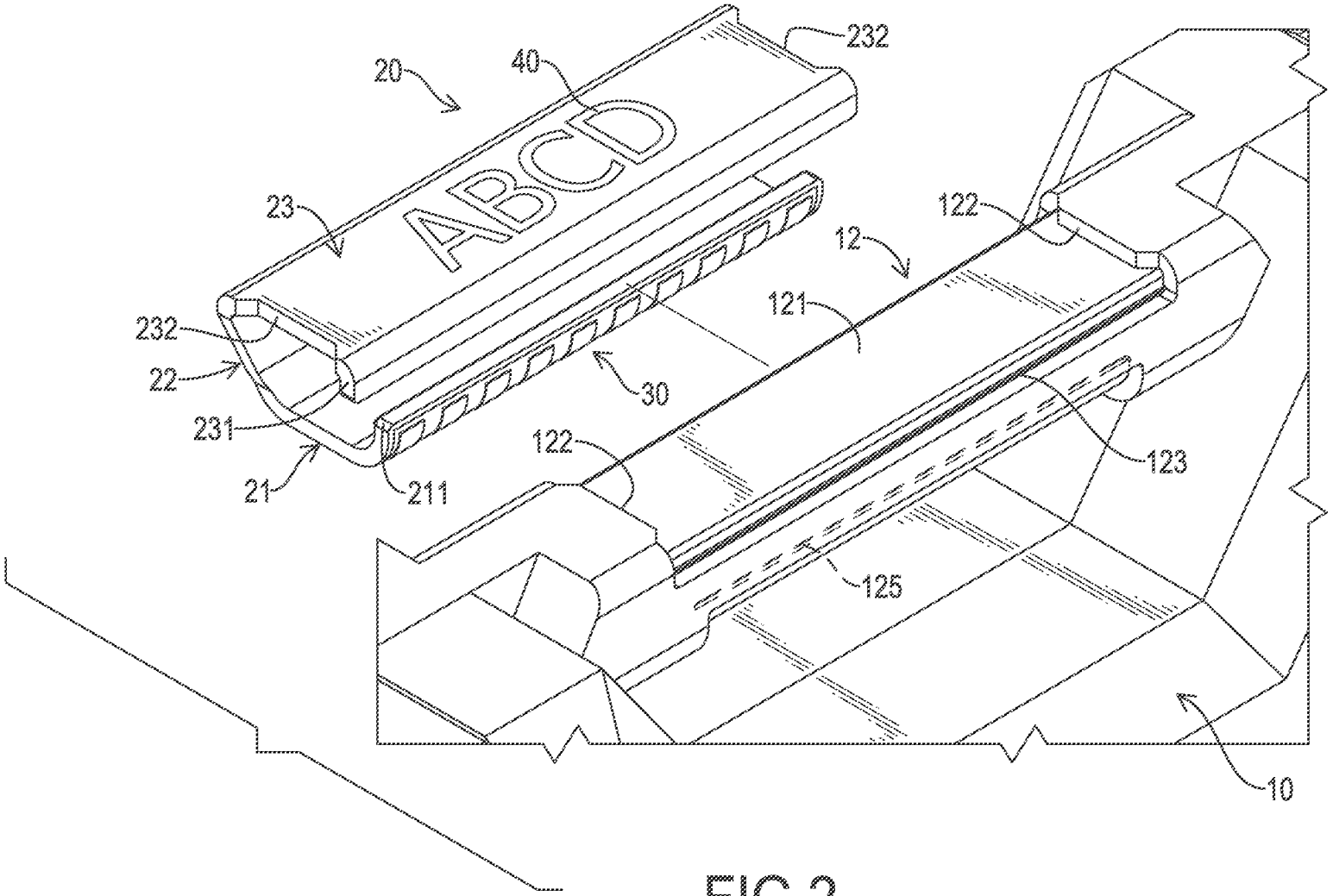
FIG. 2 is an exploded perspective view of a handle and the toolbox in FIG. 1.
Figure 3:
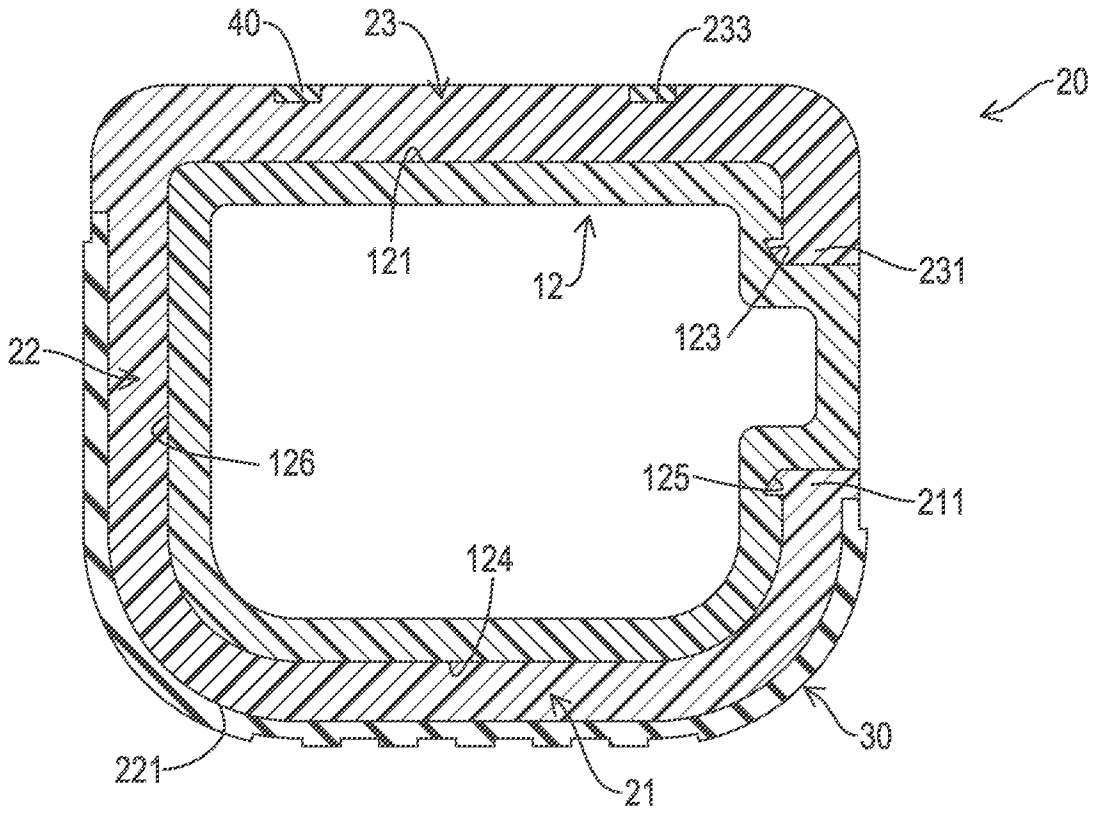
FIG. 3 is an enlarged cross section side view of the handle and the toolbox in FIG. 1.
Figure 4:
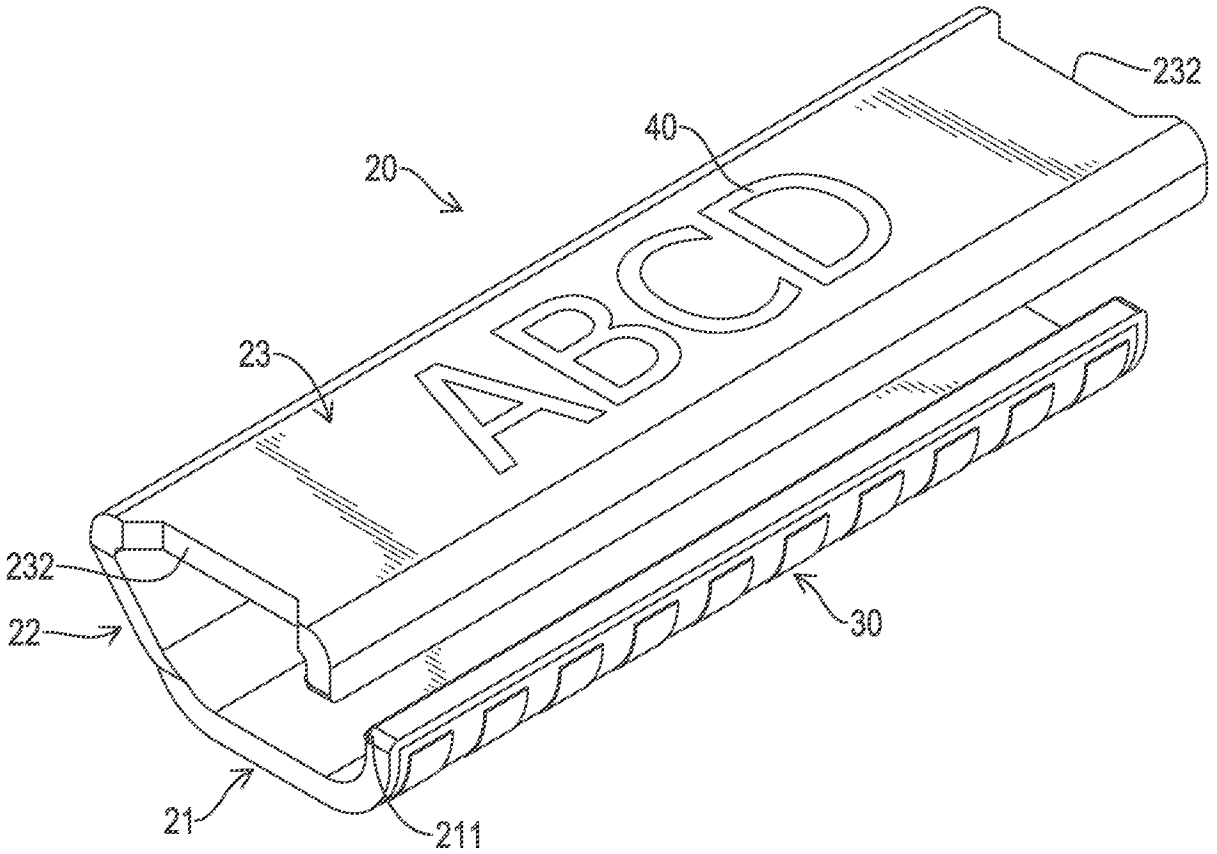
FIG. 4 is an enlarged perspective view of the handle in FIG. 1.

With reference to FIGS. 1 to 3, when the handle 20 of the present invention is in use, the handle 20 may be engaged with the mounting portion 12 of the toolbox 10. The holding portion 21 is engaged with the lower positioning recess 124, and the lower engaging protruding portion 211 is engaged with the lower engaging recess 125. Besides, the marking portion 23 is engaged with the upper positioning recess 121, and the two upper limiting protruding portions 122 are respectively engaged with the two alignment recesses 232 of the marking portion 20. Therefore, the handle 20 can be engaged with the mourning portion 12 conveniently.

To sum up, the present invention has the following advantages.

1. The holding portion 21 is engaged with the lower positioning recess 124, and the lower engaging protruding portion 211 is engaged with the lower engaging recess 125. Besides, the marking portion 23 is engaged with the upper positioning recess 121, and the two upper limiting protruding portions 122 are respectively engaged with the two alignment recesses 232 of the marking portion 23. The handle 20 can be engaged with the mounting portion 12 conveniently and tightly.

2. Once the handle 20 is broken after long time use, the handle 20 is replaceable. A use does not need to replace the whole toolbox 10, and the cost for using the toolbox 10 may be reduced significantly.

3. The injection recess 221 is formed in an outer surface of the connecting portion 22 and the holding portion 21. A holding block 30 may be attached on the injection recess 221 of the handle 20 by plastic injection, and this may improve the holding feel for a user.

4. The marking structure 233 is formed in the top surface of the marking portion 23. The marking structure 233 can be grooves to form a trademark pattern. Therefore, the user may recognize the marking portion 23 rapidly.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A toolbox comprising:

a box body having a mounting portion mounted at the box body and having a top surface;

a bottom surface;

an upper positioning recess formed in the top surface of the mounting portion; and a lower positioning recess formed in the bottom surface of the mounting portion; and a handle detachably mounted around and engaged with the mounting portion of the box body, and having a holding portion being an elongated board and engaged with the lower positioning recess of the mounting portion, a cross section of the holding portion being U-shaped with an opening facing upward;

a connecting portion formed at an inner end of the holding portion and being a board; and a marking portion formed at a top portion of the connecting portion and being an elongated board and engaged with the upper positioning recess of the mounting portion, a cross section of the marking portion being U-shaped with an opening facing downward;

wherein a lower engaging recess is formed in an outer edge of the lower positioning recess of the mounting portion; and the holding portion has an outer side and a lower engaging protruding portion protruding from the outer side of the holding portion and engaging with the lower engaging recess, a cross section of the lower engaging protruding portion being a trapezoid in shape;

wherein an upper engaging recess is formed in an outer edge of the upper positioning recess of the mounting portion; and the marking portion has an outer end and an upper engaging protruding portion protruding from the outer end of the marking portion and engaging with the upper engaging recess, a cross section of the upper engaging protruding portion being a trapezoid in shape;

wherein the mounting portion has two upper limiting protruding portions respectively protruding from two side edges of the upper positioning recess; and the marking portion has two alignment recesses respectively formed in two ends of the marking portion and respectively engaged with the two upper limiting protruding portions of the mounting portion.

2. The toolbox as claimed in claim 1, wherein a connecting recess is formed in an outer surface of the mounting portion, the connecting recess communicates with the upper positioning recess and the lower positioning recess, and the connecting portion engages with the connecting recess.

3. The toolbox as claimed in claim 2, wherein an injection recess is formed in an outer surface of the connecting portion and the holding portion, and a holding block engages with the injection recess.

4. The toolbox as claimed in claim 3, wherein a marking structure is formed on a top surface of the marking portion.

5. The toolbox as claimed in claim 1, wherein an injection recess is formed in an outer surface of the connecting portion and the holding portion, and a holding block is engaged with the injection recess.

6. The toolbox as claimed in claim 5, wherein a marking structure is formed on a top surface of the marking portion.

* * * * *